US010563486B2

(12) United States Patent
Malbrel

(10) Patent No.: US 10,563,486 B2
(45) Date of Patent: Feb. 18, 2020

(54) SCREEN ASSEMBLY FOR A RESOURCE EXPLORATION SYSTEM

(71) Applicant: Christophe Malbrel, Houston, TX (US)

(72) Inventor: Christophe Malbrel, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 160 days.

(21) Appl. No.: 15/494,065

(22) Filed: Apr. 21, 2017

(65) Prior Publication Data

US 2017/0350219 A1 Dec. 7, 2017

Related U.S. Application Data

(63) Continuation-in-part of application No. 15/174,464, filed on Jun. 6, 2016.

(51) Int. Cl.
*E21B 33/124* (2006.01)
*E21B 43/08* (2006.01)

(52) U.S. Cl.
CPC ..... *E21B 43/086* (2013.01); *E21B 33/1243* (2013.01)

(58) Field of Classification Search
CPC ..... E21B 43/08; E21B 33/12; E21B 43/086; E21B 43/10; E21B 43/103
See application file for complete search history.

(56) References Cited

U.S. PATENT DOCUMENTS 5,183,110 A * 2/1993 Logan ..... E21B 43/04 166/278
8,286,704 B2 10/2012 Chan et al.
2003/0079885 A1 5/2003 Schetky et al.
2003/0234111 A1* 12/2003 Echols ..... E21B 17/1014 166/382

(Continued)

FOREIGN PATENT DOCUMENTS

WO 2017213773 12/2017

OTHER PUBLICATIONS

Carrejo,Nick, "Completion & Production: Bonded Bead Screen Sizing for Formation Sand Control", Baker Hughes Incorporated, Apr. 11, 2016, Revision 2, 4 pages.

(Continued)

*Primary Examiner* — Daniel P Stephenson
(74) *Attorney, Agent, or Firm* — Cantor Colburn LLP

(57) ABSTRACT

A method of passing downhole fluids through a screen assembly mounted to a tubular run into a well bore. The screen assembly has a plurality of screen sections arranged at a resource production zone between a first swellable member and a second swellable member. The method includes passing a fluid through an annular screen of the plurality of screen sections into the tubular. At least a portion of the fluid includes particulate matter. Particulate matter is accumulated at the annular screen. Particulate matter is detected in the fluid. The fluid passes into one or more of a plurality of inner screen compartments provided on an inner tubular member radially inwardly spaced from the tubular, and the fluid is filtered through an erosion resistant annular screen of one or more of the plurality of inner screen compartments.

12 Claims, 8 Drawing Sheets

(56) References Cited

U.S. PATENT DOCUMENTS

| | | | | |
|---|---|---|---|---|
| 2008/0283240 | A1 | 11/2008 | Baaijens et al. | |
| 2009/0218101 | A1 | 9/2009 | Langlais et al. | |
| 2011/0036567 | A1 | 2/2011 | Holderman et al. | |
| 2011/0073308 | A1 | 3/2011 | Assal et al. | |
| 2011/0203793 | A1 | 8/2011 | Tibbles | |
| 2013/0008652 | A1* | 1/2013 | Broussard | E21B 33/124 166/278 |
| 2013/0248178 | A1 | 9/2013 | Hecker et al. | |
| 2014/0151039 | A1 | 6/2014 | Corre et al. | |
| 2015/0300133 | A1 | 10/2015 | Songire et al. | |
| 2016/0017697 | A1 | 1/2016 | Di Pietro | |
| 2016/0040515 | A1 | 2/2016 | Yeh et al. | |
| 2017/0350218 | A1 | 12/2017 | Malbrel | |
| 2017/0350219 | A1* | 12/2017 | Malbrel | E21B 33/1243 |

OTHER PUBLICATIONS

Notification of Transmittal of the International Search Report and the Written Opinion of the International Searching Authority; PCT/US2017/030998; dated Aug. 2, 2017; 13 pages.

* cited by examiner

SCREEN ASSEMBLY FOR A RESOURCE EXPLORATION SYSTEM

CROSS-REFERENCE TO PRIOR APPLICATIONS

This application is a continuation-in-part of U.S. patent application Ser. No. 15/174,464, filed on Jun. 6, 2016, the contents of which are expressly incorporated herein by reference in its entirety.

BACKGROUND

During various downhole operations there may be a need to control sand and/or other debris entrained with downhole fluids. Sand screens may be provided about a tubular having inlet openings that receive downhole fluids. The sand screens may include one or more layers each having gradually increasing opening sizes with an outer most screen layer including openings that are smaller than an innermost screen layer. Over time, produced sand impinges on screen surface causing erosion and/or clogging of the sand screen that could lead to screen failure.

Clogging of a sand screen may lead to the development of hot spots or speeds up screen erosion and subsequent failure. More specifically, a clogged screen may lead to a reduction in inflow area. As a result of a reduced flow area, fluids pass through the screen at an increased velocity. The increased velocity passing through the openings increases erosion that may ultimately lead to a screen failure. Screen failure may allow fluids to pass into a tubular without first passing through a screen.

SUMMARY

A method of passing downhole fluids through a screen assembly mounted to a tubular run into a well bore. The screen assembly has a plurality of screen sections arranged at a resource production zone between a first swellable member and a second swellable member. The method includes passing a fluid through an annular screen of each of the plurality of screen sections of the screen assembly into the tubular. At least a portion of the fluid in the downhole zone includes particulate matter. Particulate matter is accumulated at the annular screen of at least one of the plurality of screen sections. Particulate matter is detected in the fluid passing into the tubular resulting from a degradation of at least one of the plurality of screen sections. The fluid passes into one or more of a plurality of inner screen compartments provided on an inner tubular member radially inwardly spaced from the tubular, and the fluid is filtered through an erosion resistant annular screen of one or more of the plurality of inner screen compartments.

A method includes flowing fluid into multiple sections of a screen assembly arranged in a production zone, continuing to flow fluid through one or more of the multiple sections of the screen assembly after others of the multiple sections have become clogged and continuing to filter the fluid passing through the screen assembly after the others of the multiple sections of the screen assembly have failed.

BRIEF DESCRIPTION OF THE DRAWINGS

Referring now to the drawings wherein like elements are numbered alike in the several Figures.

DETAILED DESCRIPTION

Figure 1:
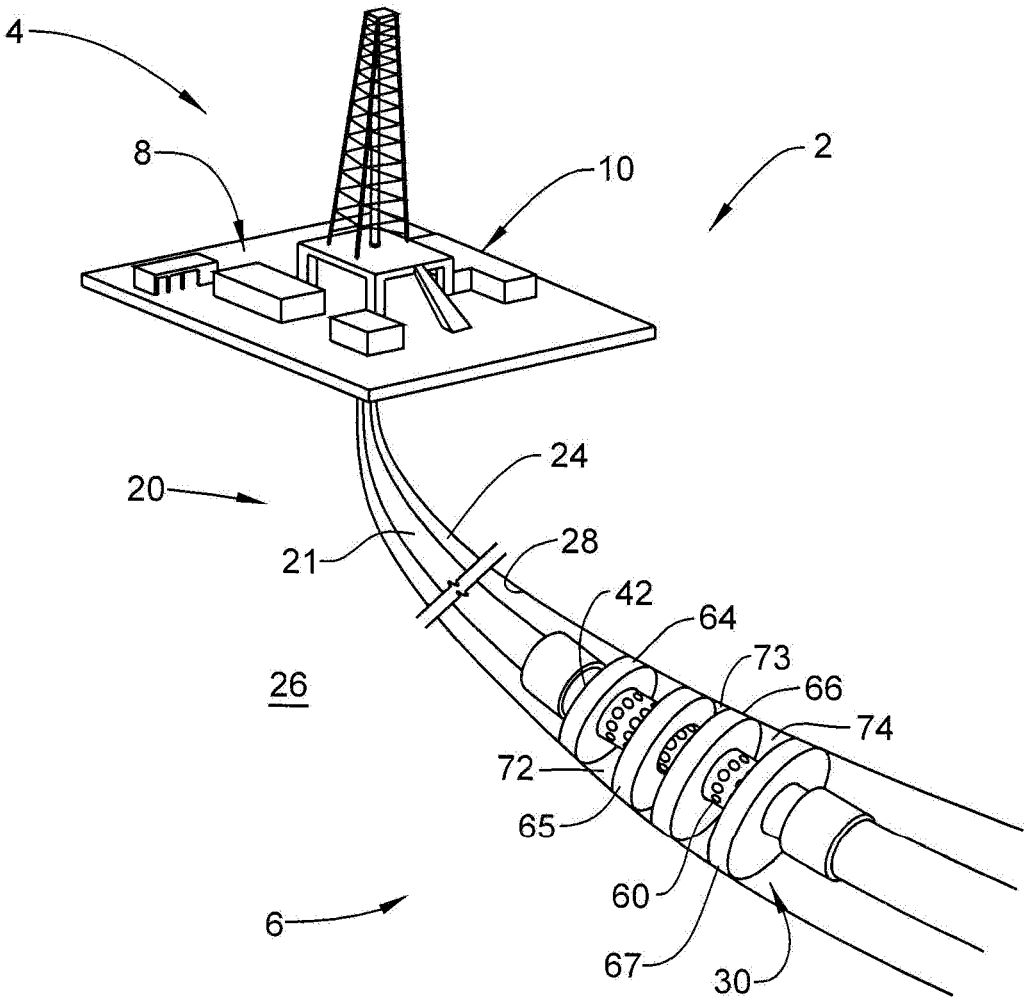
FIG. 1 depicts a resource exploration system including a screen assembly, in accordance with an exemplary embodiment.

A resource exploration system, in accordance with an exemplary embodiment, is indicated generally at 2, in FIG. 1. Resource exploration system 2 should be understood to include well drilling operations, resource extraction and recovery, $CO_2$ sequestration, and the like. Resource exploration system 2 may include an uphole portion 4 operatively connected to a downhole portion 6. Uphole portion 4 may include pumps 8 that aid in completion and/or extraction processes as well as fluid storage 10. Fluid storage 10 may contain a gravel pack fluid or slurry (not shown) that is introduced into downhole portion 6.

Downhole portion 6 may include a downhole string 20 formed from a plurality of tubulars, one of which is indicated at 21 that is extended into a wellbore 24 formed in formation 26. Wellbore 24 includes an annular wall 28 that may be defined by formation 26. It is to be understood that annular wall 28 may also be defined by a casing. One of tubulars 21 may be connected with a screen assembly 30. Screen assembly 30 filters out or blocks various particles from entering downhole string 20 during select downhole operations.

Figure 2:
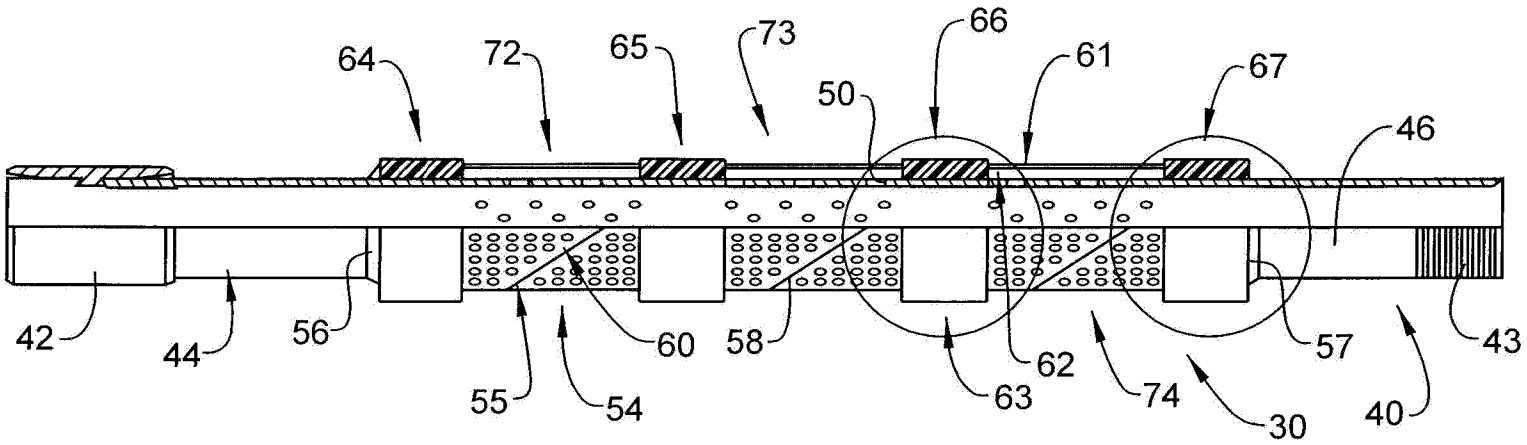
FIG. 2 depicts a partial cross-sectional side view of the screen assembly of FIG. 1.
Figure 4:
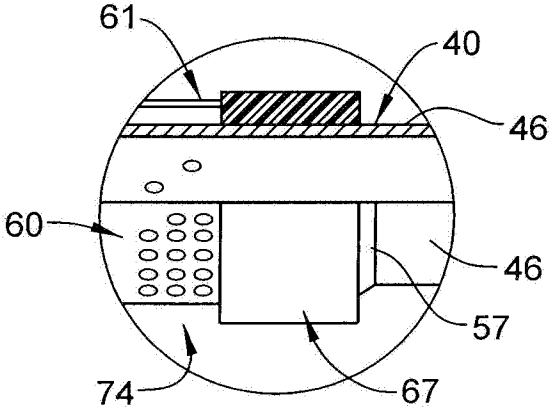
FIG. 4 depicts a detail view of another portion of the screen assembly of FIG. 2.
Figure 3:
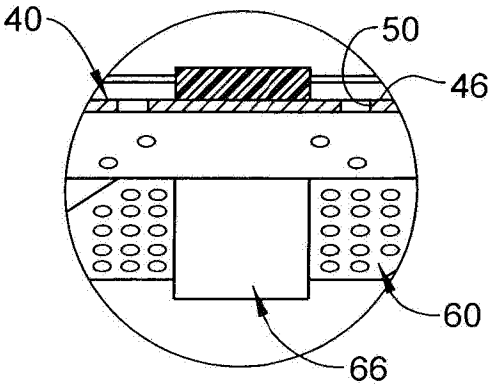
FIG. 3 depicts a detail view of a portion of the screen assembly of FIG. 2.

With reference to FIGS. 2-4 screen assembly 30 includes a tubular 40 having a first or box end 42, a second or pin end 43 and an intermediate portion 44 having an outer surface 46 extending therebetween. Tubular 40 includes a plurality of openings 50 that extend through outer surface 46. A screen 54 is provided on tubular 40. Screen 54 defines an annular screen 55 that extends over each of the plurality of openings 50. Annular screen 55 includes a first end portion 56, a second end portion 57, and an intermediate zone 58. Annular screen 55 includes a plurality of screen openings, one of which is indicated at 60. Plurality of screen openings 60 extend from an outer surface 61 of annular screen 55 through intermediate zone 58 to an inner surface 62.

In accordance with an aspect of an exemplary embodiment, screen assembly 30 includes a plurality of deformable members depicted as swellable members 63 arranged on outer surface 61 of annular screen 55. Plurality of swellable members 63 includes a first swellable member 64, a second swellable member 65, a third swellable member 66 and a fourth swellable member 67. First swellable member 64 is arranged at first end portion 56 of annular screen 55 adjacent to first end 42 of tubular 40. Fourth swellable member 67 is arranged at second end portion 57 of annular screen 55 adjacent second end 43 of tubular 40. Second and third swellable members 65 and 66 are arranged along intermediate zone 58 of annular screen 55. It is to be understood that the number of swellable members may vary.

In further accordance with an exemplary embodiment, swellable members 64-67 are selectively radially outwardly swellable to engage with annular wall 28 of wellbore 24. Once engaged, swellable members 64-67 form a first screen compartment 72, a second screen compartment 73, and a third screen compartment 74. Screen compartments 72-74 are fluidically isolated from one another externally of tubular 40. In this manner, in the event that a portion of screen 54 becomes clogged or otherwise fails to pass fluids, other portions of screen 54 may remain operational. The development of screen compartments 72-74 mitigate risks associated with erosion and plugging by reducing exposure to small sections of screen 54 that may be covered rapidly while other areas of screen 54 remain open and unobstructed.

Figure 5:
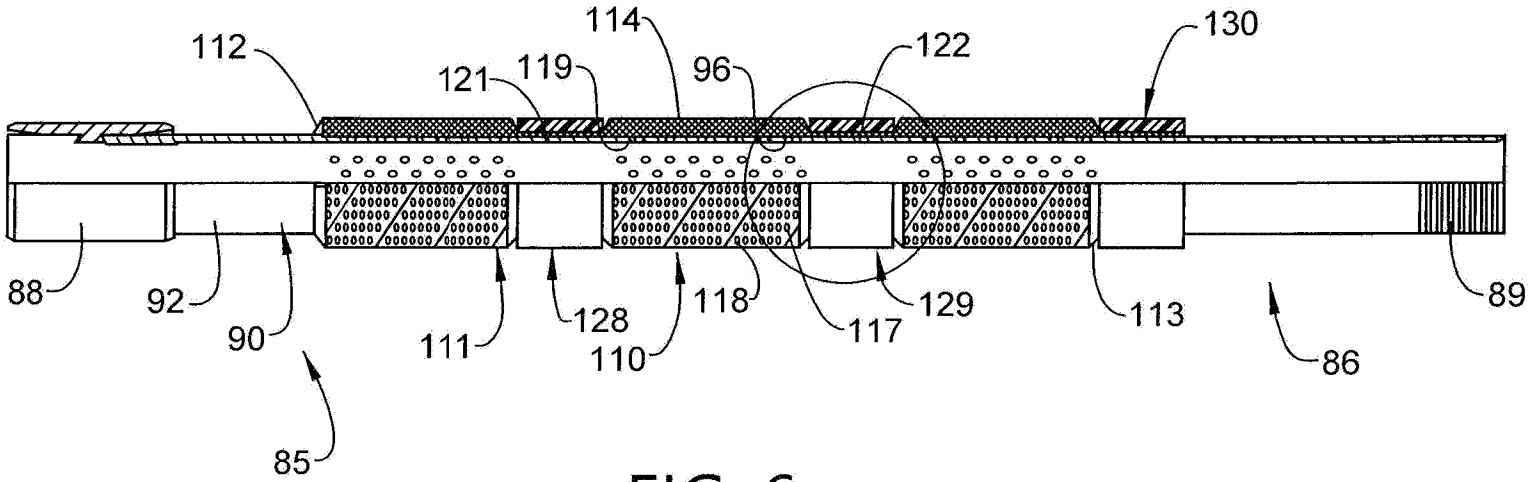
FIG. 5 depicts a partial cross-sectional side view of a screen assembly, in accordance with another aspect of an exemplary embodiment.
Figure 6:
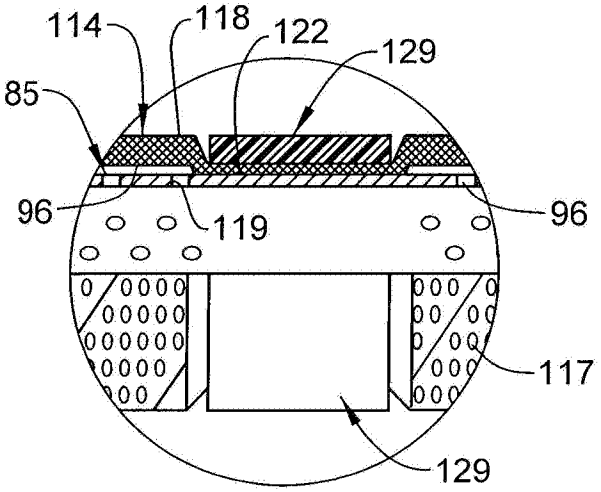
FIG. 6 depicts a detail view of a portion of the screen assembly of FIG. 5.

Reference will follow to FIGS. 5 and 6 in describing a screen assembly 85 in accordance with another aspect of an exemplary embodiment. Screen assembly 85 includes a tubular 86 having a first end 88, a second end 89 and an intermediate portion 90 including an outer surface 92 extending therebetween. Tubular 86 includes a plurality of openings 96 that extend through outer surface 92. A screen 110 is provided on tubular 86. Screen 110 defines an annular screen 111 that extends over each of the plurality of openings 96. Annular screen 111 includes a first end portion 112, a second end portion 113, and an intermediate zone 114. Annular screen 111 includes a plurality of screen openings, one of which is indicated at 117. Plurality of screen openings 117 extend from an outer surface 118 of annular screen 111 through intermediate zone 114 to an inner surface 119.

Annular screen 111 further includes a first swaged zone 121 and a second swaged zone 122. Each swaged zone 121, 122 represents an area of annular screen 111 in which inner surface 119 has been compressed toward outer surface 92 of tubular 86. In accordance with an aspect of an exemplary embodiment, inner surface 119 of annular screen 111 directly abuts outer surface 92 of tubular 86. It is to be understood that the number of swaged zones may vary.

In further accordance with an exemplary aspect, screen assembly 85 includes a first swellable member 128 that extends about annular screen 111 at first swaged zone 121, a second swellable member 129 that extends about annular screen 111 at second swaged zone 122 and a third swellable member 130 that extends about outer surface 92 of tubular 86 at second end portion 113 of annular screen 111. It is to be understood that the number of swellable members may vary. In a manner similar to that described above, swellable members 128-130 are selectively radially outwardly expandable to abut annular wall 28 creating a number of screen compartments (not separately labeled) that are fluidically isolated from one another externally of tubular 86.

Figure 7:
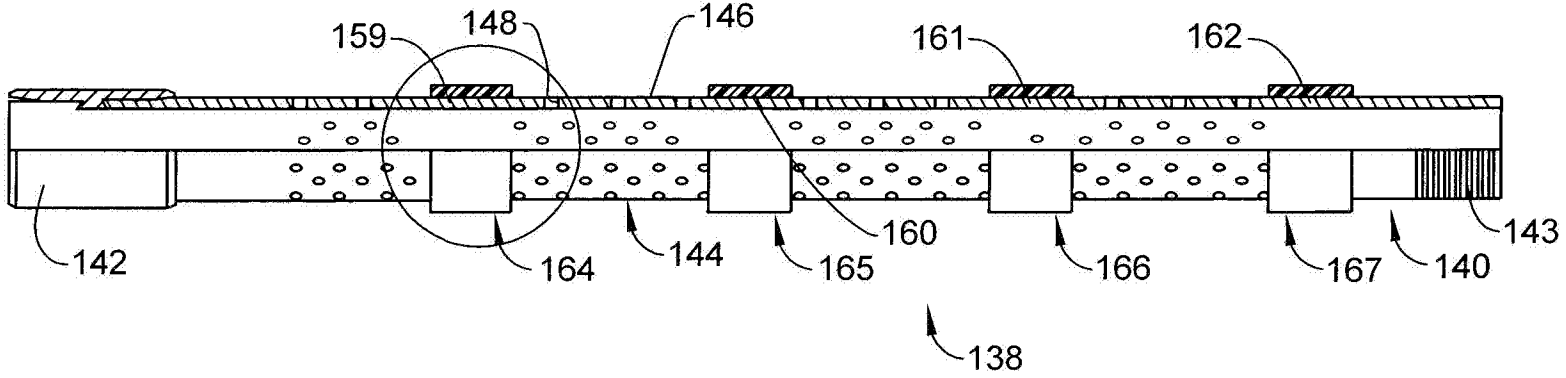
FIG. 7 depicts a partial cross-sectional view of a screen assembly, in accordance with another aspect of an exemplary embodiment.
Figure 8:
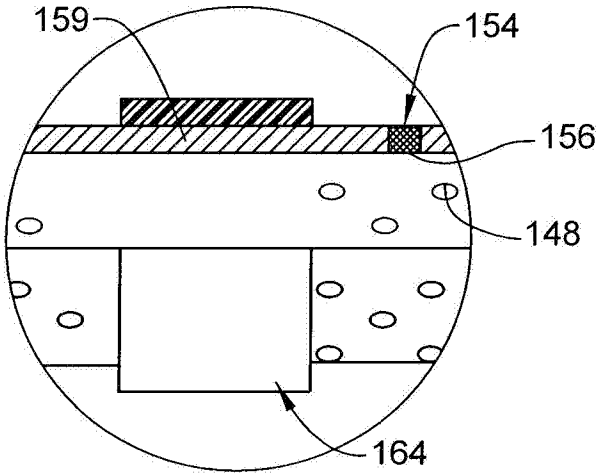
FIG. 8 depicts a detail view of a portion of the screen assembly of FIG. 7.

Reference will now follow to FIGS. 7 and 8 in describing a screen assembly 138 in accordance with another aspect of an exemplary embodiment. Screen assembly 138 includes a tubular 140 having a first end 142, a second end 143 and an intermediate portion 144 having an outer surface 146 extending therebetween. Tubular 140 includes a plurality of openings 148 that extend through outer surface 146. A plurality of screens, shown in the form of screen members, one of which is indicated at 154 is arranged in corresponding ones of the plurality of openings 148 in tubular 140. Screen members 154 filter fluid flowing through plurality of openings 148 and may take the form of sintered beads 156. It is to be understood that screen members 154 may also take the form of a welded mesh and/or consolidated gravel.

In accordance with an aspect of an exemplary embodiment, tubular 140 may include a first opening-free zone 159, a second opening-free zone 160, a third opening-free zone 161 and a fourth opening-free zone 162. Each opening-free zone 159-162 defines a section of intermediate portion 144 that is devoid of openings. In further accordance with an exemplary aspect, a first swellable member 164 is arranged at and extends about first opening-free zone 159. A second swellable member 165 is arranged at and extends about second opening-free zone 160, a third swellable member 166 is arranged at and extends about third opening-free zone 161, and a fourth swellable member 167 is arranged at and extends about fourth opening-free zone 162. In a manner similar to that described above, swellable members 164-167 are selectively radially outwardly expandable to abut annular wall 28 creating a number of screen compartments (not separately labeled) that are fluidically isolated from one another externally of tubular 140.

Figure 9:
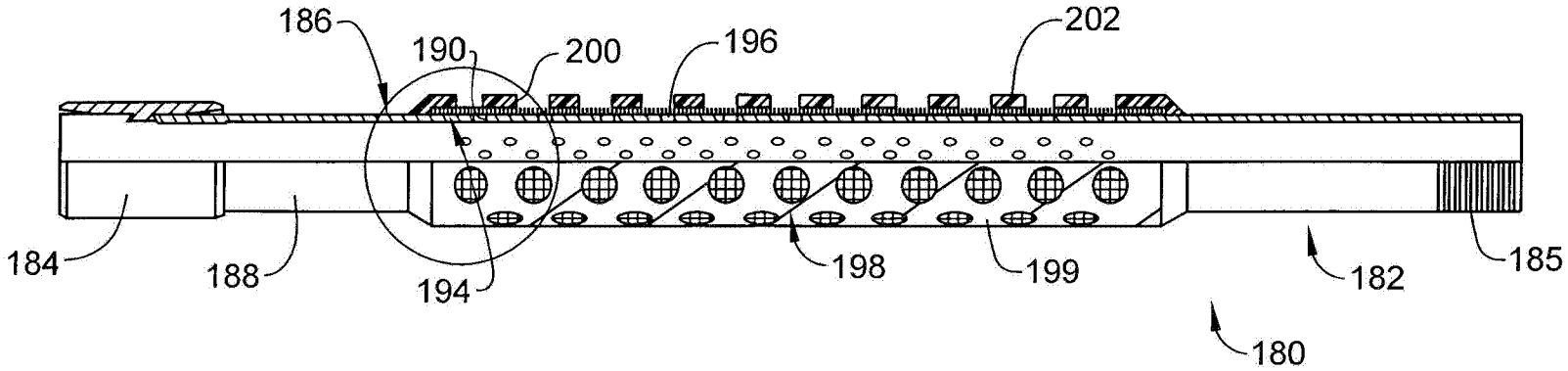
FIG. 9 depicts a screen assembly, in accordance with yet another aspect of an exemplary embodiment.
Figure 11:
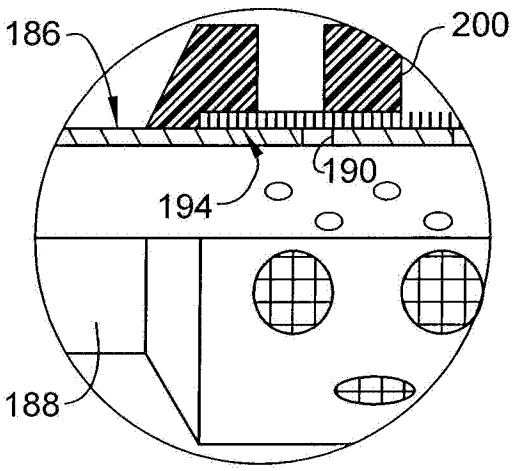
FIG. 11 depicts a detail view of a portion of the screen assembly of FIG. 9, showing a deformable member in a second configuration.
Figure 10:
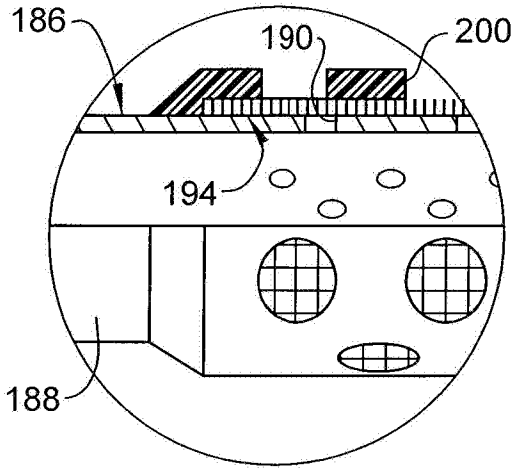
FIG. 10 depicts a detail view of a portion of the screen assembly of FIG. 9 showing a deformable member in a first configuration.

Reference will now follow to FIGS. 9-11 in describing a screen assembly 180 in accordance with yet another aspect of an exemplary embodiment. Screen assembly 180 includes a tubular 182 having a first end 184, a second end 185 and an intermediate portion 186 having an outer surface 188 extending therebetween. Tubular 182 includes a plurality of openings 190 that extend through outer surface 188. A screen 194 extends over tubular 182. Screen 194 may take the form of an annular screen 196 that extend about intermediate portion 186.

In accordance with an exemplary aspect, screen assembly 180 includes a swellable member 198 that extends across and about intermediate portion 186 across each of the plurality of openings 190. Swellable member 198 includes an outer surface 199 and a plurality of passages 200 defined by portions 202 of outer surface 199. Passages 200 register with the plurality of openings 190 creating a fluid pathway into an interior portion (not separately labeled) of tubular 182. In a manner similar to that described above, swellable member 198 selectively radially outwardly expands such that outer surface 199 abuts annular wall 28. Each of the plurality of passages 200 forms a discrete screen compartment (not separately labeled) that is fluidically isolated from other screen compartments externally of tubular 140.

Figure 12:
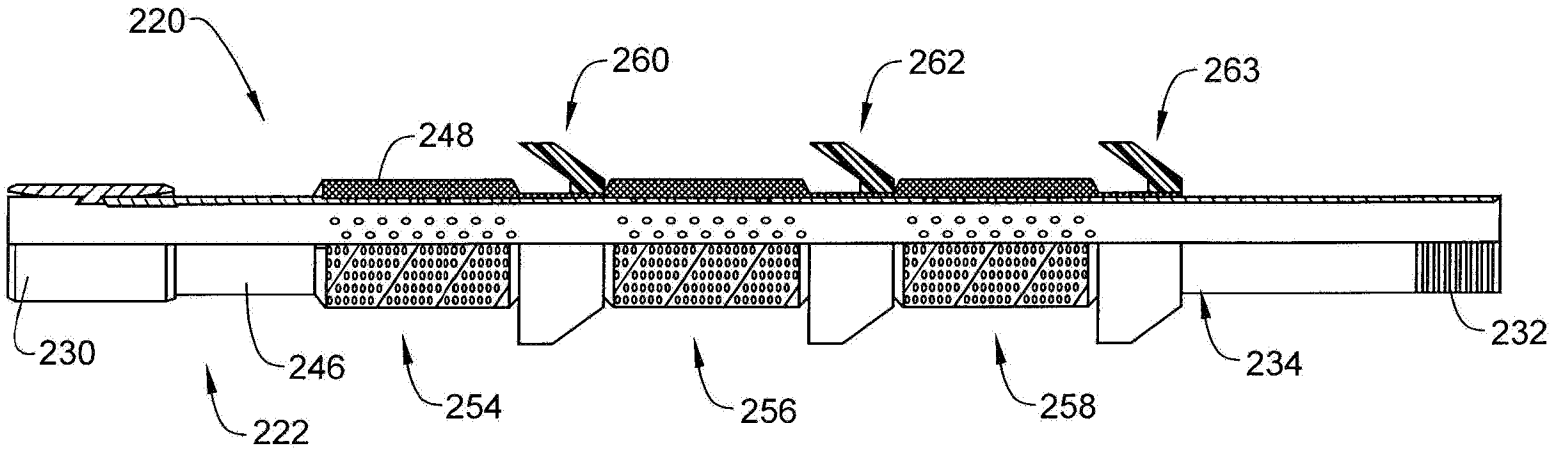
FIG. 12 depicts a partial cross-sectional view of a screen assembly, in accordance with still yet another aspect of an exemplary embodiment.

Reference will now follow to FIG. 12 in describing a screen assembly 220 in accordance with another aspect of an exemplary embodiment. Screen assembly 220 includes a tubular 222 having a first end 230, a second end 232 and an intermediate portion 234 having an outer surface 246 extending therebetween. Tubular 222 includes a plurality of openings 248 that extend through outer surface 246. A first screen 254 is positioned on outer surface 246 across openings 248, a second screen 256 is positioned on outer surface 246 spaced from first screen 254 and a third screen 258 is positioned on outer surface 246 spaced from second screen 256. It is to be understood that the number of screens may vary.

In further accordance with an exemplary aspect, screen assembly 220 includes a first deformable member 260 that extends about tubular 222 between first screen 254 and second screen 256, a second deformable member 262 that extends about tubular 222 between second screen 256 and third screen 258 and a third deformable member 263 that extends about tubular 222 adjacent third screen 258. It is to be understood that the number of swellable members may vary. In a manner similar to that described above, deformable members 260, 262, and 263 are selectively radially outwardly deformable creating a number of screen compartments (not separately labeled) that are fluidically isolated from one another externally of tubular 222. For example, deformable members 260, 262, and 263 may be expanded upon the shifting of tubular 222 relative to formation 26.

Figure 13:
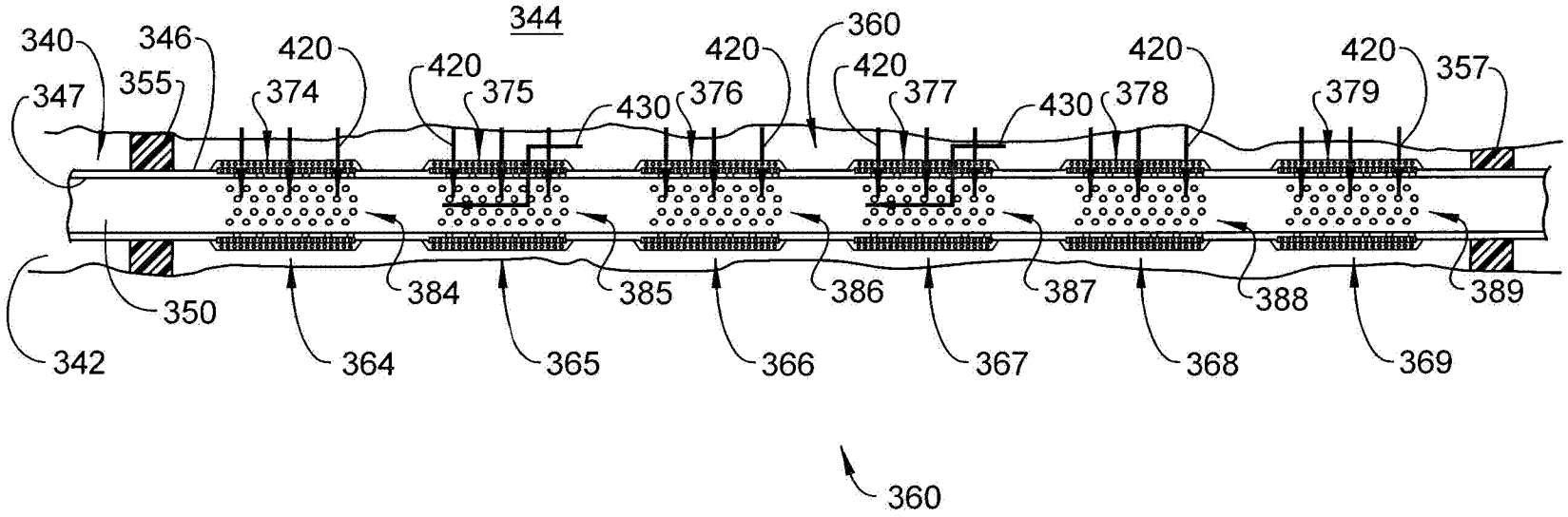
FIG. 13 ( PRIOR ART )
FIG. 13 depicts a screen assembly arranged downhole, in accordance with an aspect of an exemplary embodiment.

Reference will now follow to FIG. 13 in describing a tubular 340 that may be run into a wellbore 342 formed in a formation 344 in accordance with prior art. Tubular 340 includes an outer surface 346 and an inner surface 347 that defines a flow path 350. A first swellable member or packer 355 is arranged on outer surface 346. First swellable member 355 is selectively expanded to engage with a wall (not separately labeled) defining wellbore 342 in formation 344. A second swellable member or packer 357 is arranged on outer surface 346 spaced from first swellable member 355. Second swellable member 357 may be selectively expanded to engage with the wall defining wellbore 342. A resource production zone 360 may be defined between first swellable member 355 and second swellable member 357.

A plurality of screen sections 364-369 are arranged at outer surface 346 and spaced, one from another, along tubular 340 within resource production zone 360. It is to be understood that the number, location and spacing of screen compartments may vary along the tubular. Each of the plurality of screen sections 364-369 includes an annular screen 374-379. Each annular screen 374 may be erosion resistant and includes a plurality of openings (not separately labeled). Each annular screen 374-379 may comprise a single screen layer or multiple screen layers each having a different sized plurality of openings. Each screen compartment 364-369 is arranged over a corresponding plurality of openings 384-389 formed in tubular 340. Openings 384-389 extend through outer surface 342 and inner surface 347 and may fluidically connect flow path 350 with resource producing zone 360.

In accordance with an exemplary aspect, resource producing zone 360 may produce fluid 420 mixed with particulate matter 430 such as sand. Over time, particulate matter 330 may accumulate at one or more of screen sections 364-369. Particulate matter 430 may accumulate within one or more of annular screens 374-379.

Figure 14:
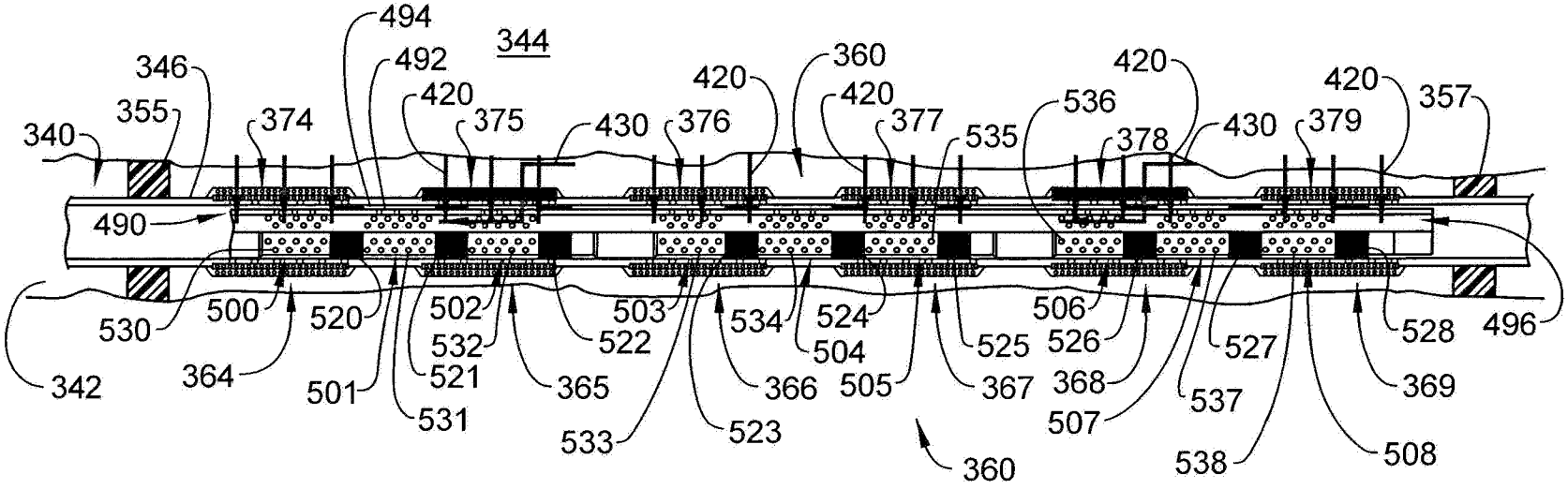
FIG. 14 depicts the screen assembly of claim 13 with one or more screen compartments clogged with particulate matter.

Accumulation of particulate matter 430 leads to hot spot formation in the corresponding one or more of the plurality of screen sections 364-369. A hot spot is an area of increase flow velocity resulting from a decrease in flowable area caused by a build-up of particulate matter 430. Over time, exposure to a hot spot may cause one or more of the plurality of screen compartments to fail. That is, an opening of increased velocity may cause one or more of annular screens 374-379 to fail thereby reducing filtering of downhole fluids. Thus, upon detecting particulate matter in the fluid passing uphole, a determination can be made that a hot spot has occurred and one or more of annular screens 374-379 may have failed. In order to avoid a need to remove tubular 340 and replace and/or repair one or more of the plurality of screen sections 364-369, an inner tubular 490 may be run into tubular 340 and positioned at the plurality of screen sections 364-369 in accordance with an exemplary embodiment, as shown in FIG. 14.

In accordance with another exemplary aspect, an inner tubular 490 includes an outer surface 492 that, when run into tubular 340, is spaced from inner surface 347 by a gap 494. Inner tubular 490 defines an inner flow path 496 that may be fluidically connected to resource producing zone 360 through screen sections 364-369 and to flow path 350 through a plurality of inner screen compartments 500-508. Inner tubular 490 may be sealed to inner surface 347 of tubular 340 through a plurality of swellable members 520-528 which, when expanded, define corresponding ones of inner screen compartments 500-508. It is to be understood that other systems for forming inner screen compartments 500-508, such as described above, may be employed. Each of the plurality of inner screen compartments includes an erosion resistant annular screen 530-538 that fluidically connects gap 394 with inner flow path 496. In this manner, and fluid entering into gap 394 passes through openings 400 toward inner flow path 396 and then along flow path 350.

In accordance with an exemplary embodiment, after one or more of the plurality of screen sections 364-369 become clogged, inner tubular member 490 may be run into tubular 340. Once in position, swellable members 520-528 may be expanded to form the plurality of inner screen compartments 500-508. In the exemplary embodiment shown, inner tubular 490 is positioned such that each of the plurality of inner screen compartments 500-508 is fluidically exposed to one or more of the plurality of screen sections 364-369. Thus, any damaged or clogged screens may be provided a back-up screen in the form of one or more of erosion resistant annular screen 530-538.

In this manner, tubular 340 may be left in place and production may continue with minimal interruption and fluids passing from formation 344 may continue to be filtered before flowing uphole despite a failure of one or more of the plurality of screen sections 364-369. The term "failure" should be understood to mean that one or more of the plurality of screen compartments may not be capable of passing fluid, or that the hot spot has created damage allowing fluid to pass unfiltered into tubular 340.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

Embodiment 1

A method of passing downhole fluids through a screen assembly mounted to a tubular run into a well bore, the screen assembly having a plurality of screen sections arranged at a resource production zone between a first swellable member and a second swellable member, the method comprising: passing a fluid through an annular screen of each of the plurality of screen sections of the screen assembly into the tubular, at least a portion of the fluid in the downhole zone including particulate matter; accumulating particulate matter at the annular screen of at least one of the plurality of screen sections; detecting particulate matter in the fluid passing into the tubular resulting from a degradation of at least one of the plurality of screen sections; passing the fluid into one or more of a plurality of inner screen compartments provided on an inner tubular member radially inwardly spaced from the tubular; and filtering the fluid through an erosion resistant annular screen of one or more of the plurality of inner screen compartments.

Embodiment 2

The method of embodiment 1, further comprising: expanding a plurality of swellable members mounted to the inner tubular member forming corresponding ones of the plurality of inner screen compartments.

Embodiment 3

The method of embodiment 1, wherein detecting the particulate matter includes determining that one or more of the plurality of screen sections has failed.

Embodiment 4

The method of embodiment 1, wherein passing the fluid into one or more of the plurality of inner screen compartments includes passing the fluid through one of the plurality of screen sections into two of the plurality of inner screen compartments.

Embodiment 5

The method of embodiment 1, wherein passing the fluid into one or more of the plurality of inner screen compartments includes passing the fluid across a gap defined between the tubular and the inner tubular member.

Embodiment 6

The method of embodiment 5, wherein accumulating the particulate matter at the annular screen includes accumulating the particulate matter in the gap.

Embodiment 7

A method comprising: flowing fluid into multiple sections of a screen assembly arranged in a production zone; continuing to flow fluid through one or more of the multiple sections of the screen assembly after others of the multiple sections have become clogged; and continuing to filter the fluid passing through the screen assembly after the others of the multiple sections of the screen assembly have failed.

Embodiment 8

The method of embodiment 7, wherein continuing to filter the fluid passing through the screen assembly after the others of the multiple sections of the screen assembly are clogged includes passing the fluid into one or more inner screen compartments defined along an inner tubular member arranged radially inwardly of the screen assembly.

Embodiment 9

The method of embodiment 8, wherein continuing to filter the fluid passing through the screen assembly includes passing the fluid through an erosion resistant annular screen of the one or more inner screen compartments.

Embodiment 10

The method of embodiment 8, further comprising: forming the one or more inner screen compartments by expanding one or more swellable members provided on the inner tubular member.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A method of passing downhole fluids through a screen assembly mounted to a tubular run into a well bore, the screen assembly having a plurality of screen sections arranged at a resource production zone between a first swellable member and a second swellable member, the method comprising:

passing a fluid through an annular screen of each of the plurality of screen sections of the screen assembly into the tubular, at least a portion of the fluid in the downhole zone including particulate matter;

accumulating particulate matter at the annular screen of at least one of the plurality of screen sections;

detecting particulate matter in the fluid passing into the tubular resulting from a degradation of at least one of the plurality of screen sections;

passing the fluid into one or more of a plurality of inner screen compartments provided on an inner tubular member radially inwardly spaced from the tubular; and filtering the fluid through an erosion resistant annular screen of one or more of the plurality of inner screen compartments.

2. The method of claim 1, further comprising: expanding a plurality of swellable members mounted to the inner tubular member forming corresponding ones of the plurality of inner screen compartments.

3. The method of claim 1, wherein detecting the particulate matter includes determining that one or more of the plurality of screen sections has failed.

4. The method of claim 1, wherein passing the fluid into one or more of the plurality of inner screen compartments includes passing the fluid through one of the plurality of screen sections into two of the plurality of inner screen compartments.

5. The method of claim 1, wherein passing the fluid into one or more of the plurality of inner screen compartments includes passing the fluid across a gap defined between the tubular and the inner tubular member.

6. The method of claim 5, wherein accumulating the particulate matter at the annular screen includes accumulating the particulate matter in the gap.

7. The method of claim 1, wherein passing the fluid into one or more of a plurality of inner screen compartments includes running an inner tubular into the tubular to the at least one of the plurality of screen sections to filter the fluid.

8. A method comprising:

flowing fluid into multiple sections of a screen assembly arranged in a production zone;

continuing to flow fluid through one or more of the multiple sections of the screen assembly after others of the multiple sections have become clogged; and continuing to filter the fluid passing through the screen assembly after one or more of the others of the multiple sections of the screen assembly have eroded allowing fluid to pass unfiltered through a portion of the screen assembly.

9. The method of claim 8, wherein continuing to filter the fluid passing through the screen assembly after the others of the multiple sections of the screen assembly are clogged includes passing the fluid into one or more inner screen compartments defined along an inner tubular member arranged radially inwardly of the screen assembly.

10. The method of claim 9, wherein continuing to filter the fluid passing through the screen assembly includes passing the fluid through an erosion resistant annular screen of the one or more inner screen compartments.

11. The method of claim 9, further comprising: forming the one or more inner screen compartments by expanding one or more swellable members provided on the inner tubular member.

12. The method of claim 8, wherein continuing to filter the fluid passing through the screen assembly after the others of the multiple sections of the screen assembly have failed includes running in an inner tubular having one or more inner screen compartments into the screen assembly.

* * * * *